United States Patent [19]

England, Jr.

[11] Patent Number: 5,007,753

[45] Date of Patent: Apr. 16, 1991

[54] WINDOW CLEANING APPARATUS WITH ROTATABLE HEAD

[76] Inventor: Raymond B. England, Jr., P.O. Box 511, Albion, N.Y. 14411

[21] Appl. No.: 295,293

[22] Filed: Dec. 30, 1988

[51] Int. Cl.[5] ..... A47L 13/26; A47L 13/30

[52] U.S. Cl. ..... 401/139; 401/281; 401/285; 401/289

[58] Field of Search ..... 401/132, 285, 289, 281, 401/283, 284; 15/117, 21, 185, 245; 403/164, 165; 239/280, 280.5, 281, 532, 587; 285/138, 272, 278, 280, 281, 138, 272, 278, 280

[56] References Cited

U.S. PATENT DOCUMENTS

| | | | |
|---|---|---|---|
| 1,163,319 | 12/1915 | Campbell | 401/285 X |
| 1,549,341 | 8/1925 | Weiss | 401/289 X |
| 1,655,585 | 1/1928 | Wagner . | |
| 2,586,472 | 2/1952 | Mckown | 15/245 X |
| 2,651,488 | 9/1953 | Sauer | 403/165 X |
| 2,722,701 | 11/1955 | Blum et al. | 401/139 |
| 3,372,948 | 3/1968 | Arneson | 285/281 X |
| 3,782,837 | 1/1974 | Feldmann | 401/281 |
| 3,810,702 | 5/1974 | Benz . | |
| 3,832,069 | 8/1974 | Petsch | 401/289 |
| 4,027,353 | 6/1977 | Unger | 15/245 |
| 4,594,015 | 6/1986 | Pomares | 401/139 X |
| 4,673,307 | 6/1987 | Prestele et al. | 401/281 X |
| 4,716,616 | 1/1988 | Poon . | |

FOREIGN PATENT DOCUMENTS

| | | | |
|---|---|---|---|
| 176249 | 6/1905 | Fed. Rep. of Germany | 401/139 |

*Primary Examiner*—Richard J. Apley
*Assistant Examiner*—D. F. Crosby
*Attorney, Agent, or Firm*—Fred L. Denson

[57] ABSTRACT

Window cleaning apparatus is described which has a cleaning head that is rotatable to any position when used on a window surface. The apparatus includes a rotatable sleeve coupling which is positioned between the cleaning head and the handle for the apparatus. A cleaning element, such as a wiper, cleaning pad, sponge or brush, is attached to the cleaning head. Because of the rotatablity of the cleaning head, the apparatus effectively cleans edges and corners of windows of any shape. The described apparatus optionally includes a fluid supply conduit for delivering a cleansing fluid from a pressurized source to a fluid distribution conduit positioned on the cleaning head. The fluid distribution conduit contains perforations which enable fluid to be sprayed onto a window surface.

4 Claims, 4 Drawing Sheets

WINDOW CLEANING APPARATUS WITH ROTATABLE HEAD

BACKGROUND OF THE INVENTION

1. Field of the Invention

This invention relates to window cleaning apparatus having a rotatable cleaning head which is fully rotatable when positioned on a window surface. The structure of the apparatus eliminates the need for manually removing the head to achieve its re-orientation. The apparatus optionally includes a rotatable fluid supply conduit for the delivery of a washing fluid to the cleaning head.

2. Description of Related Art

Several types of devices have been used for cleaning windows. A typical device usually contains a handle and a cleaning element such as a wiper or sponge, each of which is attached to a cleaning head. Extensions are connected to the handle when the device is used to clean windows in high locations. Some of the devices are also equipped with a tube which delivers a washing fluid from a pressurized source such as a tank or water tap, to the cleaning head for application to the window. A device of this type is disclosed in U.S. Pat. No. 1,655,585. The cleaning head and its associated cleaning element are not rotatable on the surface of a window. Thus, the operator is required to manipulate the handle in order to change the orientation of the cleaning element. Such re-orientation provides the most effective way to clean window edges and corners and to clean windows that are not of the normal rectangular configuration.

U.S. Pat. No. 3,810,702 describes a device having a rotatable cleaning head which facilitates the cleaning of window edges and corners. The number of parts and their structural arrangement make this device more expensive than standard devices and also make it more prone to mechanical failure because of corrosion or part malfunction. U.S. Pat. No. 4,716,616 discloses a device having a rotatable cleaning head which is more rugged than other devices that use ball joints to impart rotatability to a cleaning head. The disadvantage of this device is that the cleaning head must be manually removed from the handle and manually repositioned thereon to achieve its re-orientation.

The objects of the present invention are to provide a window cleaning apparatus which has a cleaning head that is rotatable to any orientation on the surface of a window without the need for its manual removal and repositioning; to provide a window cleaning apparatus that is sturdy, economic and efficient for cleaning corners and edges of windows of any shape; and to provide a window cleaning apparatus that has a fluid supply conduit with a rotatable union for preventing the conduit's twisting and failure.

SUMMARY OF THE INVENTION

In accordance with the present invention, window cleaning apparatus is provided having a cleaning head which is fully rotatable on a window surface. A cleaning element such as a wiper or cleaning pad is attached to the cleaning head which is fastened to a rotatable sleeve coupling. A handle is also attached to the rotatable sleeve coupling. The rotatable sleeve coupling has an inner sleeve which is telescopically fitted into an outer sleeve. The inner sleeve has a groove on its outer surface which is rotatably mated with a correspondingly positioned rim on the inner surface of the outer sleeve. The apparatus of this invention optionally includes a fluid supply conduit for delivering a cleansing fluid from a pressurized source to a fluid distribution conduit positioned on the cleaning head. The fluid distribution conduit contains perforations or a plurality of apertures which enables fluid to be sprayed onto a window surface. Part of the fluid supply conduit is disposed inside of the rotatable sleeve coupling. This part of the fluid supply conduit contains a rotatable union which permits the conduit to freely rotate with the rotatable sleeve coupling without leakage or twisting.

Because the cleaning head is rotatable to any position on the surface of window, the effectively cleans edges and corners of windows any shape. The sleeve coupling provides a strong, durable rotatable connection which is not prone to failure. The is efficient and convenient to use since it easily assembled and disassembled for transport or Moreover, the simplicity of its structure lends its economic fabrication. While the primary use of the apparatus of this invention is for cleaning windows, it is equally useful for cleaning other types of work surfaces.

The invention and its objects and advantages will become more apparent by referring to the accompanying drawings and to the ensuing detailed description of the preferred embodiments.

DETAILED DESCRIPTION OF THE PREFERRED EMBODIMENTS

Figure 1:
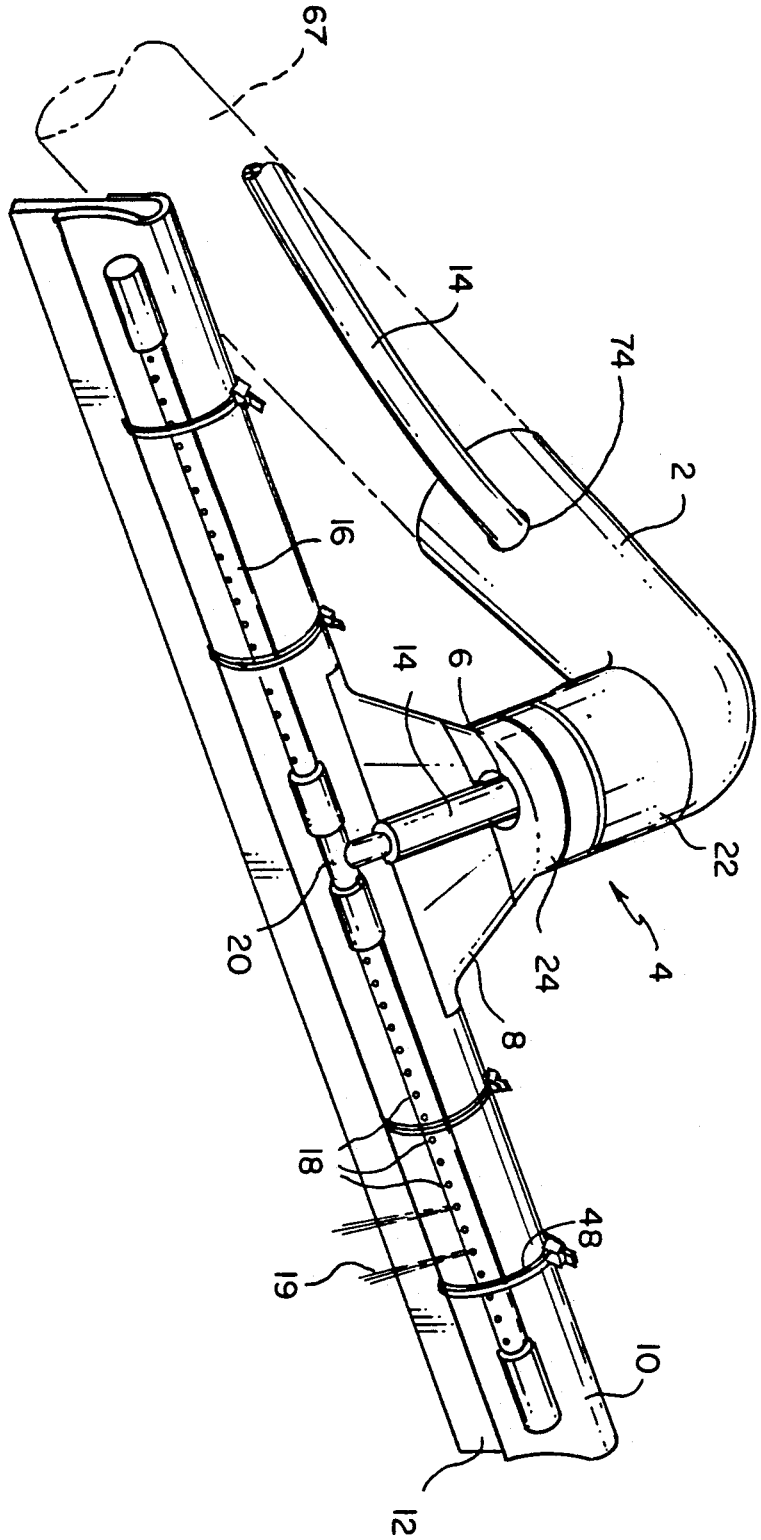
FIG. 1 is a pictorial representation of the window cleaning apparatus of this invention.
Figure 2:
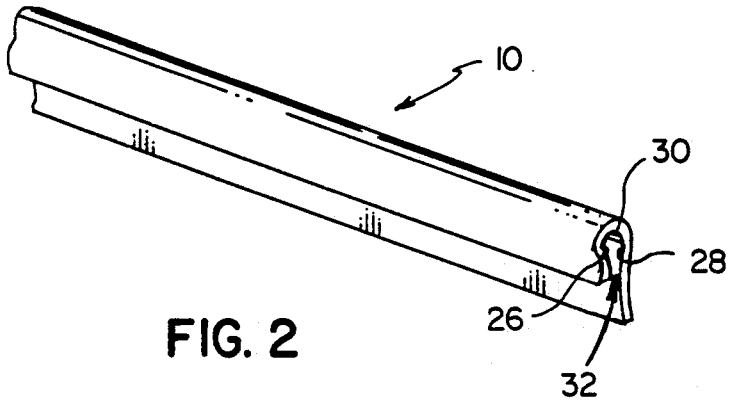
FIG. 2 is a fragmentary perspective view of the cleaning head of the apparatus of this invention.
Figure 3:
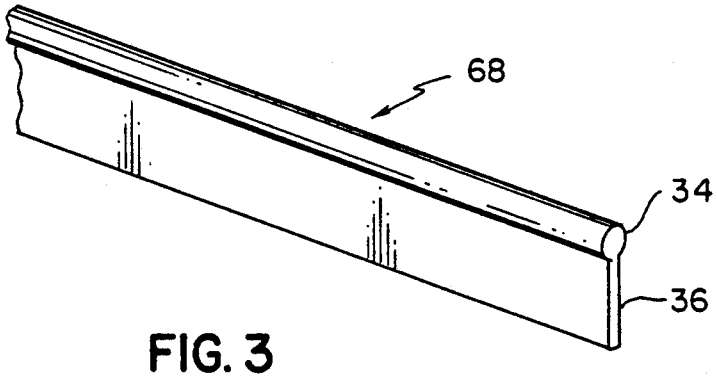
FIG. 3 is a fragmentary perspective view of a cleaning element which is used in conjunction with the cleaning head of FIG. 2.

As shown in FIG. 1, the window cleaning apparatus of this invention includes cleaning head 10, handle 2 and rotatable sleeve coupling 4. One end of rotatable sleeve coupling 4 is attached to cleaning head 10 by any suitable fastening means such as bracket 8. The other end of sleeve coupling 4 is connected to handle 2 by welding, threading, collaring or other conventional joining means. Cleaning element 12 is attached to cleaning head 10. Typical cleaning elements which are attached to cleaning head 10 include brushes, wipers, scraping blades, sponges, squeegees, cleaning pads and the like. Cleaning head 10 is preferably a U shaped, elongated channel as shown in FIG. 2. The U shaped elongated channel has side walls 26 and 28 which are joined together by base 30. A cleaning element such as wiper 68 of FIG. 3 is attached to channel 10 by inserting wiper spine 34 into channel trough 32. Side wall 28 is longer than side wall 26 to provide added support to wiper 68 when wiper blade 36 is applied to a work surface such as a window.

Figure 6:
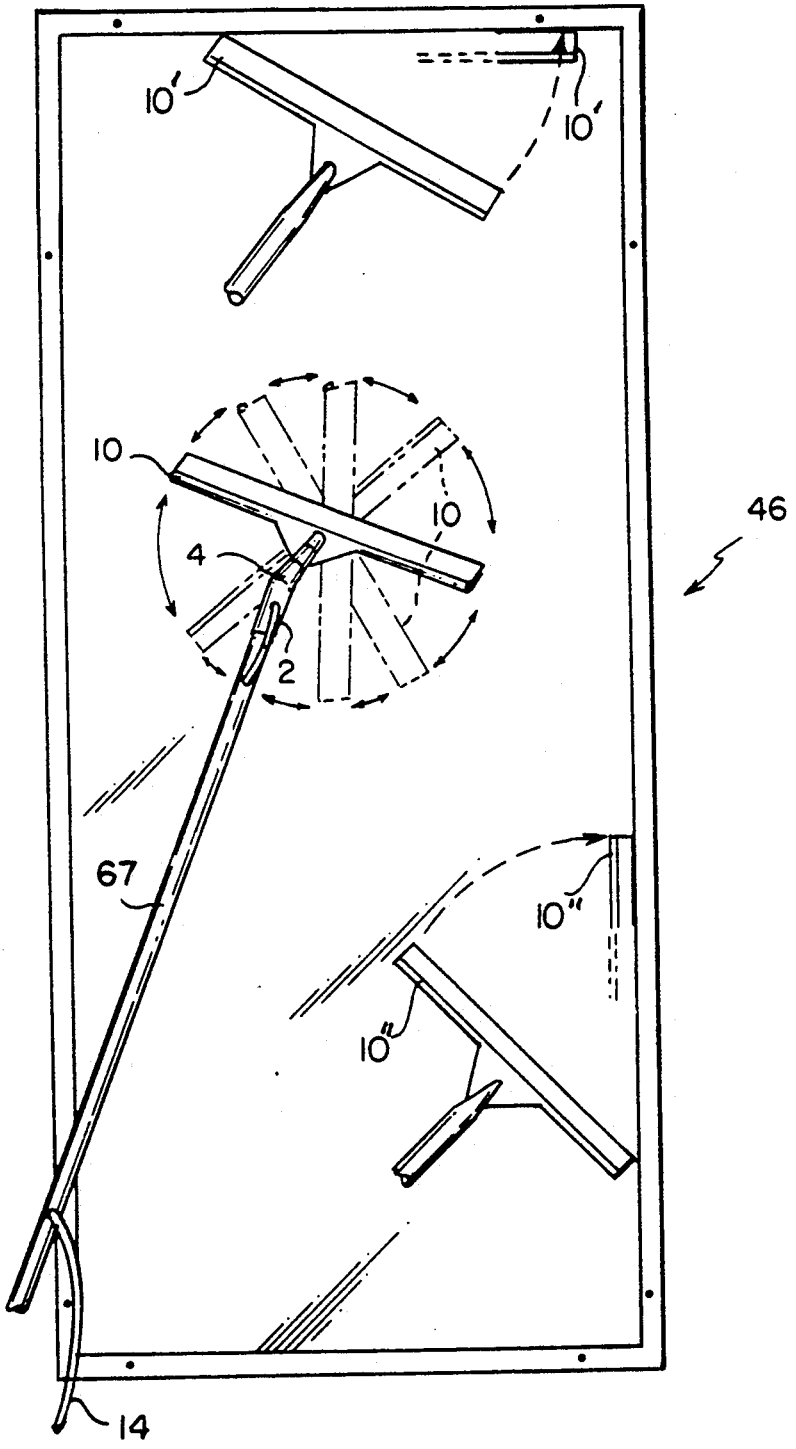
FIG. 6 is a planar view of the apparatus of this invention which shows its cleaning head oriented at various positions on a window surface.

The structure of coupling 4 makes cleaning head 10 fully rotatable in the plane of a work surface when cleaning element 12 is applied to the work surface. Thus, work surfaces of various shapes can be cleaned along edges and near corners without the need for removing the cleaning element and re-orienting it to accommodate the configuration of the work surface. FIG. 6 shows cleaning head 10 oriented in several directions on the surface of window 46 because of the structure of rotatable sleeve coupling 4. FIG. 6 also shows the use of handle extension 67 in conjunction with handle 2 of the apparatus of this invention.

Figure 4A:
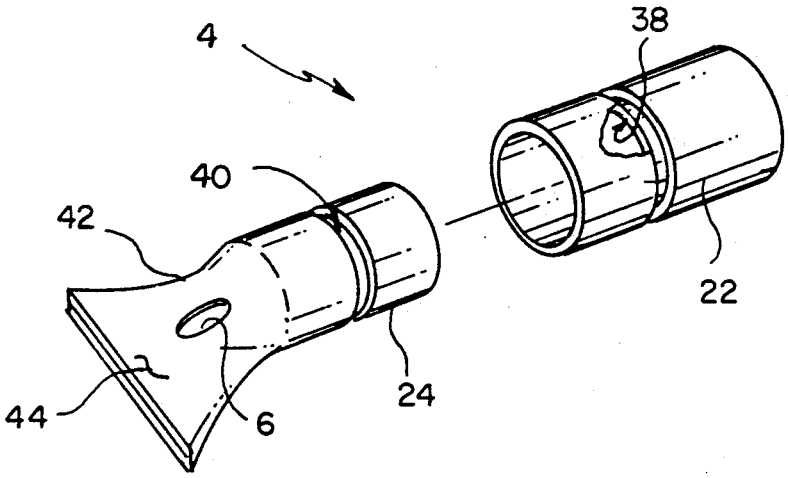
FIG. 4*a* is a perspective view of a rotatable sleeve coupling which comprises a part of the apparatus of this invention.
Figure 4B:
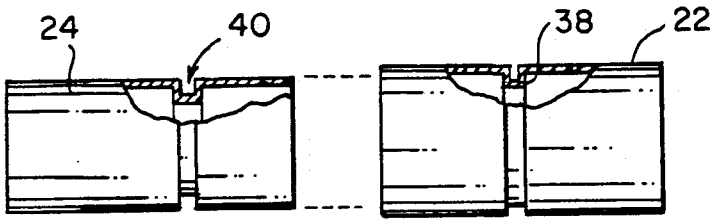
FIG. 4*b* is a diagrammatic view of the rotatable sleeve coupling shown in FIG. 4*a*.

The structure of rotatable sleeve coupling 4 is shown in FIG. 4*a* and 4*b*. Outer sleeve 22 is a hollow cylinder which has an annular rim 38 disposed on its inner surface in proximity to one of its ends. Inner sleeve 24 is also a hollow cylinder which is slightly smaller in diameter than outer sleeve 22. Inner sleeve 24 has an open end and a closed, flanged end which is formed by collapsing together a part of the cylinder side wall 42 into a flattened surface 44. Inner sleeve 24 has an annular groove 40 disposed on its outer surface in proximity to its open end. Groove 40 is rotatably mateable with rim 38. Inner sleeve 24 is telescopically fitted into outer sleeve 22 by seating rim 38 into groove 40. Because groove 40 and rim 38 are rotatably mated, inner sleeve 24 and outer sleeve 22 are rotatable with respect to each other. Thus, cleaning head 10 is rotatable with respect to handle 2 and a cleaning surface to which cleaning element 12 is applied. Coupling 4 is connected to cleaning head 10 by attaching flange 44 to cleaning head 10 by bolting or other suitable means.

In another embodiment of the invention, a fluid is supplied from a fluid source such as a pressurized tank or tap to the cleaning head and onto the work surface. As shown in FIG. 1, a fluid supply conduit such as tube 14 is attached to handle 2. Tube 14 is inserted into the inside of rotatable sleeve coupling 4 through apertures 6 and 74 and terminates at T connector 20. A fluid distribution conduit such as tube 16 is attached to cleaning head 10 by any suitable means such as straps 48. Tube 16 contains a series of spaced apart perforations 18 and is divided into two parts such that one part is positioned on each side of T connector 20. One of the ends of each part of tube 16 terminates at T connector 20 which places fluid distribution tube 16 in communication with fluid supply tube 14. Fluid passes through tube 14 and is supplied to tube 16. Fluid 19 emerges from tube 16 through perforations 18 which distribute it onto a work surface.

Figure 5:
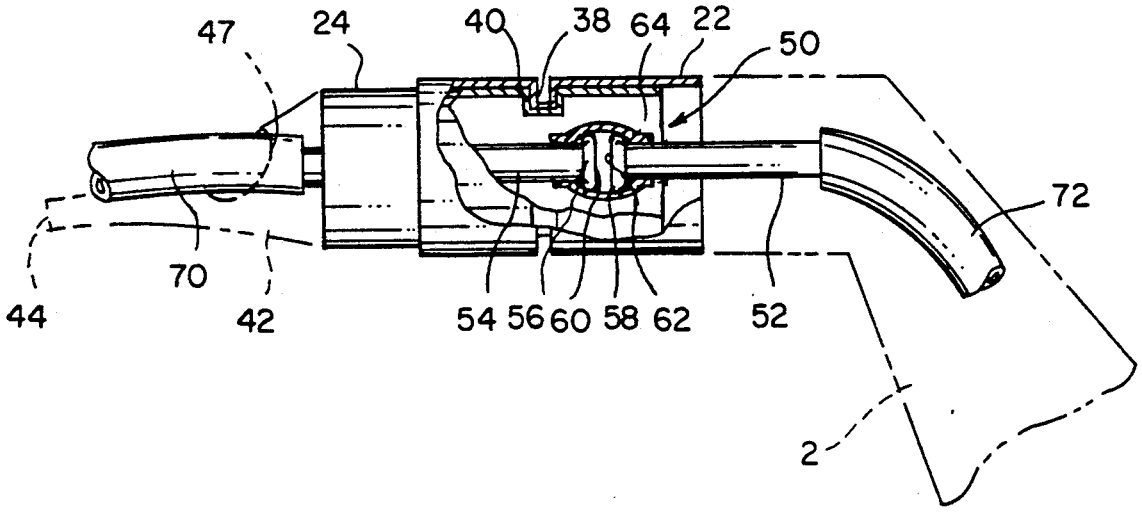
FIG. 5 is a diagrammatic view of a rotatable union for the part of the fluid supply conduit which is positioned inside of the rotatable sleeve coupling.

The part of fluid supply tube 14 which is positioned inside of rotatable sleeve coupling 4 contains a rotatable union 50 as shown in FIG. 5. Rotatable union 50 prevents tube 14 from twisting, weakening and failing which would otherwise result from the rotation of sleeve coupling 4 if rotatable union 50 were not used. Tube 14 is severed into two sections, 52 and 54 at a point of tube 14 that is positioned inside of rotatable sleeve coupling 4. A beaded lip 58 containing orifice 62 is attached to the end of tube part 52. A similar beaded lip 56 containing orifice 60 is attached to the end of tube part 54. Tube parts 52 and 54 are connected by sleeve 64 which is made from any flexible material that is resistant to liquids which are commonly used for cleaning purposes. Bead lips 56 and 58, when inserted in sleeve 64, make tube parts 52 and 54 freely rotatable with respect to each other. Beaded lips 56 and 58 also provide an efficient seal against fluid leakage. Thus, union 50 rotates with sleeve coupling 4 thereby preventing twisting, weakening and subsequent failure of fluid supply tube 14. Tube parts 52 and 54 are connected to the fluid supply conduit by sleeve 72 and 70 respectively.

The apparatus of this invention is conveniently and quickly assembled for use by attaching handle 2 to handle extension 67. Also, the apparatus is readily adapted for the delivery of fluid to a work surface by passing supply tube 14 through rotatable sleeve coupling 4, by strapping distribution tube 16 to cleaning head 10 and by connecting tubes 14 and 16 together by T joint 20. While the device is most often used to clean windows of any shape, it is also suitable for cleaning any work surface such as building facades, mirrors, synthetic sidings and the like. Because cleaning head 10 is rotatable cleaning element 12 effectively cleans along the edges of a work surface disposed at various angles without a need for manually removing cleaning head 10 and repositioning it to accommodate the orientation of such edges. As shown in FIG. 6, when one end of the cleaning element of cleaning head 10' or 10'' contacts an edge of a work surface, the other end of the cleaning element rotates so that the length of the entire element is positioned along the edge of the work surface. The structure of rotatable sleeve coupling 4, and particularly the overlapping of its component cylinders 22 and 24, make it strong and durable so that it is not prone to failure on repeated use. When fluid supply conduit 14 is used, it too is long lasting because of the efficient and leak-proof rotatable union 50 positioned within coupling 4.

The invention has been described in detail with reference to a preferred embodiment thereof. However, it will be understood that variations and modifications can be effected within the spirit and scope of the invention. For example, handle 2 can be configured at any angle which best suits the user. Moreover, the functions of the apparatus are readily transferable to other useful applications.

I claim:

1. Window cleaning apparatus for cleaning a window comprising:

a. a cleaning head;

b. a cleaning element which is attached to the cleaning head;

c. a rotatable sleeve coupling having a closed, flanged end and an open, tubular end, said coupling being comprised of 1. a smaller hollow cylinder having a side wall having an opening therethrough an open end and a closed flanged end formed by collapsing together a part of the cylinder side wall into a flattened surface, said smaller hollow cylinder containing an annular groove disposed on its outer surface in proximity to its open end, 2. a larger hollow cylinder having a side wall with an opening therethrough, two open ends and an annular rim with an opening therethrough, two open ends and an annular rim disposed on its inner surface in proximity to one of its open ends, said rim being rotatably mateable with the annular groove of the smaller cylinder;

the open end of the smaller hollow cylinder being telescopically fitted in to the open end of the larger hollow cylinder which is in proximity to the annular rim so that the annular rim on the inner surface of the large cylinder is rotatably mated with the annular groove on the outer surface of the smaller cylinder;

d. a fastening means which attaches the cleaning head to the closed, flanged end of the rotatable sleeve coupling;

e. a handle which is attached to the open, tubular end of the rotatable sleeve coupling the handle having a bend therein adjacent the rotatable sleeve coupling wherein when the handle is held to extend with a substantial vertical component the cleaning head rotates in a plane parallel to a substantially vertically oriented window which is being cleaned;

f. a perforated, fluid distribution conduit attached to the outer surface of one of the side walls of the elongated channel forming the cleaning head for distribution fluid onto a window surface;

g. a fluid supply conduit for supplying fluid to the perforated fluid distribution conduit from a fluid source having one of its ends in communication with the perforated fluid distribution conduit and another of its ends in communication with the fluid source, said fluid supply conduit passing through the opening in the side wall of the smaller hollow cylinder and the surface of the rotatable sleeve coupling in a manner such that a part of said fluid supply conduit is positioned inside of the rotatable sleeve coupling; and h. a rotatable union situated in the part of the fluid supply conduit positioned inside of the rotatable sleeve coupling, said rotatable union being comprised of two of the ends of the fluid supply conduit formed by severing the fluid supply conduit into two sections which are re-connected by a sleeve, each of said ends having an annular, beaded lip positioned thereon which permits their full rotation in relation to the sleeve and to each other.

2. Window cleaning apparatus of claim 1 wherein the rotatable sleeve coupling permits rotation of the cleaning head to any angle on a window surface.

3. Window cleaning apparatus of claim 1 wherein the cleaning head is an elongated channel having two side walls and a base.

4. Window cleaning apparatus of claim 3 wherein the cleaning element is attached to the cleaning head by insertion into the elongated channel.

* * * * *